US012607003B2

(12) United States Patent
Moobark

(10) Patent No.: US 12,607,003 B2
(45) Date of Patent: Apr. 21, 2026

(54) PORTABLE BEDSIDE URINAL

(71) Applicant: Said S Moobark, Vero Beach, FL (US)

(72) Inventor: Said S Moobark, Vero Beach, FL (US)

( * ) Notice: Subject to any disclaimer, the term of this patent is extended or adjusted under 35 U.S.C. 154(b) by 127 days.

(21) Appl. No.: 18/810,688

(22) Filed: Aug. 21, 2024

(65) Prior Publication Data

US 2026/0055590 A1 Feb. 26, 2026

(51) Int. Cl.
*E03D 13/00* (2006.01)

(52) U.S. Cl.
CPC ..... *E03D 13/00* (2013.01)

(58) Field of Classification Search
CPC ..... E03D 13/00; E03D 13/005; E03D 13/007; A47K 11/00; A47K 11/12
USPC ..... 4/301, 144.1, 144.3, 450, 454, 462
See application file for complete search history.

(56) References Cited

U.S. PATENT DOCUMENTS 3,642,023 A * 2/1972 Rembert ..... B60N 3/18 222/394
6,021,531 A * 2/2000 Kirko ..... A47K 11/12 4/144.1
6,493,883 B2 * 12/2002 Jones ..... A47K 11/12 4/144.1
2020/0281423 A1 * 9/2020 Juc ..... A47K 11/12

FOREIGN PATENT DOCUMENTS

WO WO-2022190119 A1 * 9/2022

* cited by examiner

*Primary Examiner* — Tuan N Nguyen
(74) *Attorney, Agent, or Firm* — Don W. Weber

(57) ABSTRACT

This portable bedside urinal allows a user to urinate without walking to the bathroom. An upper, top filling section, a middle clean water reservoir, and a lower bottom waste water reservoir are generally cylindrical and stacked on one another to form the outer container. An upper funnel rests on the top of the shell container and is connected to an expandable and flexible waste water tube. Waste water runs down the funnel and waste water tube and is deposited in the lower waste water reservoir. A water pump is used for cleaning and flushing the device after use and is also located within the container The pump has a flexible and expandable clean water tube connected to both the pump and the upper funnel. After use, the pump circulates clean water to the funnel to flush the device. Using the device is simple.

12 Claims, 1 Drawing Sheet

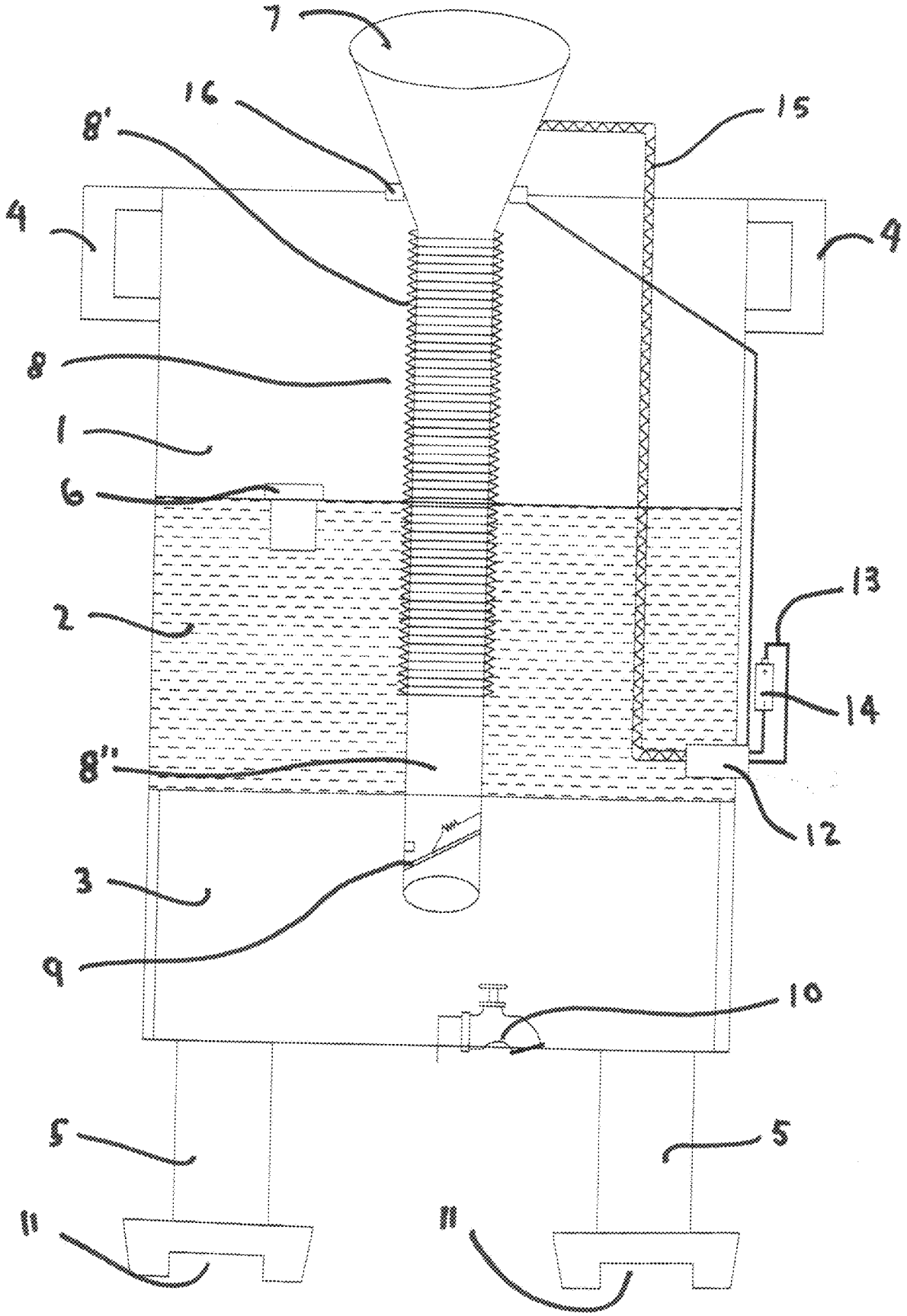
7
16
15
8'
4
4
8
1
6
13
2
14
8''
12
3
9
10
5
5
11
11

PORTABLE BEDSIDE URINAL

BACKGROUND OF THE INVENTION

This invention relates to the field of general plumbing or bedside hospital devices. More particularly, a portable bedside urinal is disclosed that may be used in either the general or hospital settings. The device is electrically cleaned using clean flush water.

In the field of portable urinals, several patents have approached the problem solved by the instant invention although they fail to provide an efficient and easy to use device. It is an object of this invention to provide a portable urinal that may be used at one's bedside, whether or not it is in a hospital setting.

The 2018 patent issued to Juc, U.S. Pat. No. 10,016,100 B1, approached the problem solved by this invention and lies in the same general field. Juc described a portable bedside urinal with an electric water pump. The Juc structure is similar in some ways to the instant device in that Juc has at least two reservoirs, a water pump 60 and a water sprayer 58. The water pump of the instant device is similar to the water pump run by electricity in Juc in that each pump is used in a portable urinal and each pump is energized electrically. However, the Juc water pump is not automatic as in the instant device but requires manual operation of the pump by switch buttons 64. The instant device is automatic. Also, and more importantly, the Juc water pump, when operated, operates a water sprayer to disinfect one reservoir of the Juc device. The instant device pumps water to flush the funnel and water waste tube and would be more efficient. The instant device, a urinal utilizing a water pump, operates in a significantly different way to do a significantly different thing than the structure described in Juc. It is another object of this invention to provide a portable urinal that also has a means for cleaning and flushing waste water into a reservoir fer easy disposal.

Another patent of interest is the 2016 patent issued to Guralnik, U.S. Pat. No. 9,386,891. The '891 patent has structure similar to the instant device but does not have a water pump automatically operated by the use of the urinal. Guralnik is of general interest in the field.

Also of interest are the 2018 patent application disclosure found in Leon (US #2018/0014991) for a bellows urinal and the application by Pettingill (US #2023/0293372) for a self-righting portable urinal container.

It is a further object of this invention to provide a portable bedside urinal with a flushing mechanism and a convenient emptying faucet. Other and further objects of this invention will become obvious upon reading the below Detailed Description of the Device.

BRIEF DESCRIPTION OF THE INVENTION

This invention has four main components: An upper, top filling section, a middle clean water reservoir, a lower bottom waste water reservoir and a water pump and tube for cleaning and flushing the device after use. The upper, middle and lower sections of this device are cylindrical in its preferred embodiment. The pump has a flexible clean water tube connected to the pump and an upper funnel. The upper funnel rests on the top of the device and is also connected to an expandable and flexible waste water tube. During use, the waste water runs down the waste water tube and is deposited in the lower waste water reservoir. When the upper funnel is replaced, the pump is activated and cleans and flushes the funnel and waste water tube.

Using the device is simple. The funnel and expandable and flexible tubes are withdrawn from the top of the device. When the funnel is replaced to its resting position, the pump is actuated for 15 seconds and cleans and flushes the funnel and waste water tube.

DESCRIPTION OF THE DRAWING FIGURE

The drawing FIGURE is a cross-sectional cutaway view of the device.

DETAILED DESCRIPTION OF THE INVENTION

This invention is comprised of three main tanks, a flexible urine hose, a flexible clean water tube, an electronic water pump operated a switch for 15 seconds and a drain.

The device comprises a generally cylindrical container. The container comprises an upper top filler section 1, a middle clean water reservoir 2 and a lower waste collecting tank section 3. The container may be of any geometrical cross-section, but a cylindrical shape for the container is preferred.

Attached to the outside of the upper filler section are handles 4, as shown. These handles are left and right handles as shown in the drawing FIGURE in the preferred embodiment but may consist of several handles located in any convenient orientation.

Attached to the bottom of the lower collecting tank section 3 are legs 5. In the preferred embodiment these are two legs, each having grooves 11. Two legs are preferred but there may be more legs while still keeping within the spirit and disclosure of this invention. The grooves 11 are adapted to receive the sides of the toilet to enable the user to place the device on a toilet for emptying.

The middle clean water reservoir 2 has a removable filling plug 6. This plug 6 is removed for filling the middle reservoir with clean water and then replaced to seal the middle reservoir.

At the very top of the device is a removable cone or funnel 7. The funnel 7 is connected to a flexible and expandable waste water tube 8. The lower end of funnel 7 rests on a circular hole in the top of the filler section 1. The funnel 7 is also fluidly connected to the upper end of the clean water tube 15.

Inside all the upper 1, middle 2 and lower 3 tanks is a flexible and expandable waste water tube 8. In the preferred embodiment of the device the waste water tube is cylindrical. Attached to the top of cylindrical waste water tube 8 is an upper funnel 7. The upper end of tube 8 protrudes through the top of the upper filler section 1 as shown. The upper part 8' of the waste water tube 8 is formed of expandable and flexible tubing. Tube 8 has a middle cylindrical expandable and flexible section 8' and a lower cylindrical section 8". The bottom part 8" of said tube protrudes through the top of the bottom section 3. This part 8" of the tube may be flexible tubing but it need not be.

Near the bottom of lower cylindrical tube section 8" is a spring actuated valve 9. This spring actuated valve 9 allows waste water to flow through to the waste water collecting tank 3 but prevents odor from rising through the device and out into the environment.

A faucet drain 10 is located at the bottom of the waste water section 3 as shown. The drain enables the user of the device to empty the accumulated waste water into a toilet after use.

An important part of this invention consists of an automatic clean water flush system shown in the drawing FIGURE. An electric water pump 12 is located inside the lower part of middle clean water section 2 as shown. The pump 12 is electrically connected to and may be energized by either DC wires 13 connected to a battery 14 or to AC power. Pump 12 is connected to the lower part of funnel 7 by flexible and expandable clean water tube 15 as shown. Tube 15 may be comprised of flexible tubing. Tube 15 has one end attached to the pump 12 and the other end attached to the funnel 7 as shown in the drawing FIGURE.

At the very top of the filler section 1 is a switch 16. The switch is in the closed position when the funnel is in its normal resting place. The switch 16 is opened when the funnel 7 is raised as the funnel is being used and the electrical circuit that powers the pump is shut off since the circuit is open. When the funnel is returned to its normal resting position after use, the switch is once again closed. The electric circuit then energizes the pump but only for about 15 seconds in the preferred embodiment. After the timer opens in approximately 15 seconds, the pump shuts off and clean water stops flowing to the funnel. The cleaning and flushing pump electrical circuit includes the switch, the timer, the pump and a source of electrical power.

When the funnel 7 and flexible tubes 8 and 15 are withdrawn from the resting place the top of the device, the switch 16 opens and the pump is not operational. When the funnel 7 and tubes 8 and 15 are returned to their resting positions, the switch 16 closes the pump circuit and the pump 12 is energized for approximately 15 seconds.

Closing the pump electrical circuit pumps clean water from the clean water section 2 to the funnel 7 by the clean water tube 15 to flush the funnel the funnel and waste water tube 8. A waste water and clean water mixture then flows downwardly through the waste water valve 10 and into the waste water collecting tank 3.

The waste water can then be drained from the lower tank 3 into a toilet using the faucet 10 and legs 5 with grooves 11 at the user's convenience. Alternatively, the waste water can be drained using the drain faucet 10 in any suitable manner.

Having fully described my device, I claim:

The invention claimed is:

1. A portable bedside urinal comprising:

(a) a container comprising a top filler section, a middle clean water reservoir section connected to a bottom of the top filer section and a bottom waste collecting section attached to a bottom of the middle clean water reservoir section;

(b) a waste water tube located inside the three sections of the container, wherein the waste water tube has an upper end protruding through a top of the top filler section and connected to a funnel, and wherein a tube middle is flexible and expandable and wherein a bottom of the waste water tube protrudes through a top of the bottom waste collecting section; and (c) a faucet drain located at a bottom of the bottom waste collecting section.

2. The bedside urinal as in claim 1 wherein the container is cylindrical.

3. The bedside urinal as in claim 1, wherein the waste water tube is cylindrical.

4. The bedside urinal as in claim 3 further comprising a spring-loaded valve located near the bottom of the waste water tube.

5. The bedside urinal as in claim 1 further comprising a water pump located inside the middle clean water reservoir section, and a flexible and expandable flushing tube, the flushing tube having one end connected to the funnel and the other end connected to the water pump.

6. The bedside urinal as in claim 5, further comprising a switch for energizing the water pump.

7. The bedside urinal as in claim 5 further comprising a switch, a timer and the water pump whereby when the waste water tube and the flushing tube and funnel are withdrawn from a resting position, the water pump is energized and pumping clean water to the funnel for flushing and cleaning the bedside urinal.

8. The bedside urinal as in claim 5 wherein the pump is energized by direct current batteries.

9. The bedside urinal as in claim 5 wherein the pump is energized by alternating current.

10. The bedside urinal as in claim 1 further comprising at least two legs attached to the bottom of the bottom collecting section.

11. The bedside urinal as in claim 10 wherein each leg has a groove adapted to receive a top edge of a toilet.

12. The bedside urinal as in claim 1 further comprising a removable filler plug located at a top of the middle clean water reservoir section whereby clean water is introduced into the middle clean water reservoir section.

* * * * *